US005111112A

United States Patent [19]

Hsu

[11] Patent Number: 5,111,112

[45] Date of Patent: May 5, 1992

[54] LIGHT STRING CONTROL APPARATUS

[76] Inventor: Yang-Wen Hsu, 1st Fl., No. 17, Kechiang Rd., Shihlin Dist., Taipei, Taiwan

[21] Appl. No.: 677,052

[22] Filed: Mar. 29, 1991

[51] Int. Cl.[5] ..... H05B 37/02

[52] U.S. Cl. ..... 315/205; 315/194; 315/208

[58] Field of Search ..... 315/205, 208, 194, 195, 315/198, 185 R, 185 S, 291

[56] References Cited

U.S. PATENT DOCUMENTS

| | | | |
|---|---|---|---|
| 4,051,411 | 9/1977 | Knoble et al. | 315/205 |
| 4,082,961 | 4/1978 | Genurt | 315/194 X |
| 4,527,099 | 7/1985 | Capewell et al. | 315/205 X |
| 4,634,933 | 1/1987 | Kamon et al. | 315/194 X |
| 4,818,917 | 4/1989 | Vest | 315/208 X |
| 4,890,000 | 12/1989 | Chou | 315/185 S |

*Primary Examiner*—Eugene R. Laroche
*Assistant Examiner*—Do Hyun Yoo
*Attorney, Agent, or Firm*—Varndell Legal Group

[57] ABSTRACT

A light string controlling apparatus includes a bridge rectifier, an RC filter, an signal generator, and a silicon controlled rectifier. The signal generator provides the gate of the silicon controlled rectifier a train of pulses or analog signals or a combination of pulses and analog signals, to control the conducting angle of the silicon controlled rectifier, affecting the flashing frequency and illumination of a light string.

1 Claim, 4 Drawing Sheets

LIGHT STRING CONTROL APPARATUS

BACKGROUND OF THE INVENTION

This invention relates to a light string control apparatus that may be inserted into a light string and has a timing control to control the flash and illumination of the light string.

One conventional way of causing a flash of a light string is by the light bulb itself. Utilizing a light bulb manufactured with a two-metal component, the expansion/contraction phenomena to reach a regular ON/-OFF state causes the flash thereof. However, the flashing-type light bulb is affected by the load current, causing a large error on its timing of ON/OFF. More particularly, the flashing type light bulb can only provide simple flashing, not a more complicated type or variable illumination. Because this flashing type light bulb utilizes a mechanical contact to control the ON/OFF, it is easily broken.

Another conventional way for providing flashing and illumination control of the light string is to utilize an electronic light flashing controller which is composed of electronic components. This electronic light flashing controller is connected directly to the AC power, converting the AC current to a DC current, and through a control circuit to control a SCR (silicon controlled rectifier) to control the flashing and illumination of a light string to which it is connected. The control circuit is an integrated timing controller which can set the flashing timing and the variable illumination period of the light string. Therefore, the light string is no longer limited to a simple flashing, now having different time intervals for flashing and variable illumination available.

However, the electronic light flashing controller has a drawback in practice, that is, it can not be used repeatedly if the light string is broken. The electronic light flashing controller is soldered on the light string or inserted into a socket engaged with the light string. In this situation, the electronic light flashing controller can be only used with this kind of light string. If one of the light bulbs is broken, the whole light string, including the electronic light flashing controller, will be useless. In addition, the electronic light flashing controller is connected in parallel with AC power directly, which presents a fire hazard if a line voltage short.

SUMMARY OF THE INVENTION

It is an object of the present invention to provide a light string controlling apparatus which can be removably and flexibly used with different light strings and provide good and repeated utilization.

It is another object of the present invention to provide a light string controlling apparatus which has two lines that do not have direction and polarity limitations, allowing the apparatus to be used with any light bulb in any light string and inserted in at any place in the light string without considering polarity.

It is still another object of the present invention to provide a light string controlling apparatus to be connected in series with the light string without causing a fire hazard problem, even when the light string controlling apparatus is shorted.

These and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Figure 1A:
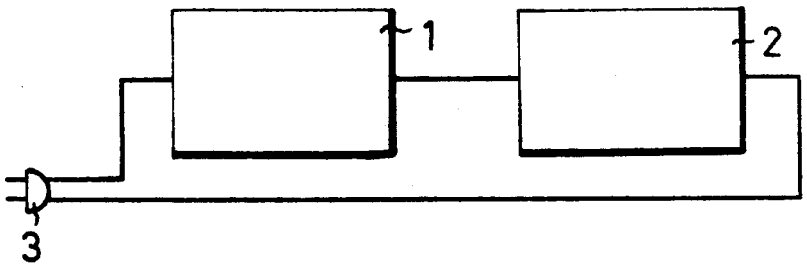
FIG. 1A is a plan view of a light string incorporated with a light string controlling apparatus in accordance with the present invention.
Figure 1C:
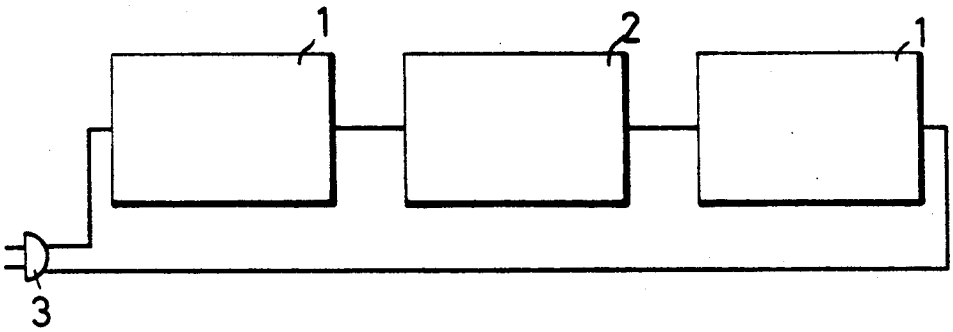
FIG. 1C is still another plan view of a light string incorporated with a light string controlling apparatus in accordance with the present invention.
Figure 1B:
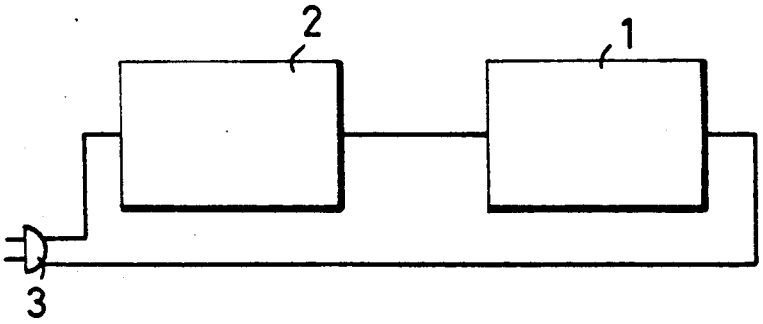
FIG. 1B is another plan view of a light string incorporated with a light string controlling apparatus in accordance with the present invention.

Referring to FIGS. 1A, 1B, and 1C, the light string controlling apparatus 2 is installed in the light string 1. There are only two terminal lines in this light string controlling apparatus 2, so that it can be connected to a light string without considering polarity or position: in FIG. 1A, the light string controlling apparatus 2 is connected at the end of a light string 1; in FIG. 1B the light string controlling apparatus 2 is connected at the beginning of the light string 1; and in FIG. 1C, the light string controlling apparatus 2 is connected between two light strings 1.

Figure 2:
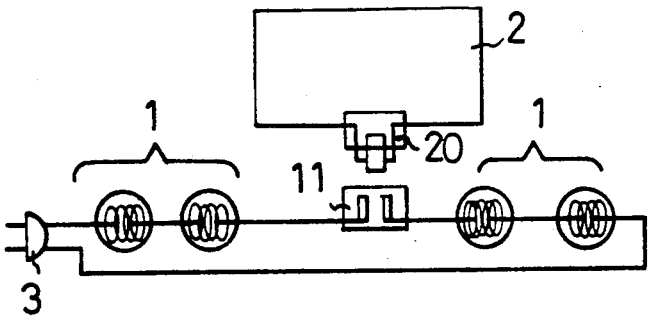
FIG. 2 is a configuration view of a string light and a string light controlling apparatus in accordance with the present invention.

Referring to FIG. 2, two terminals of the light string controlling apparatus 2 are manufactured as a plug 20 to incorporate with a socket 11 in the light string 1. A user merely needs to replace a light bulb in the light string 1 with a light string controlling apparatus 2, for the control of the light string 1, such as flashing and variable illumination to function.

If the user desires different kinds of flashing style or variable illumination, he can remove the old light string controlling apparatus 2 and insert a new and different model. Both light string controlling apparatuses can be removed and kept for future use.

Figure 3:
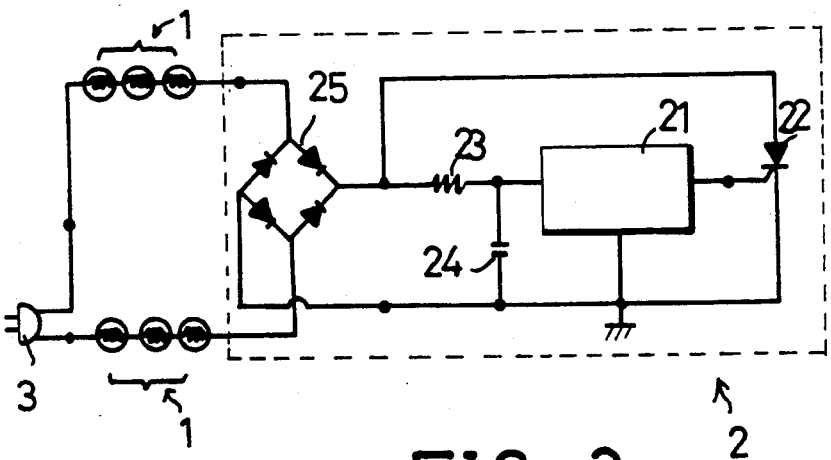
FIG. 3 is a schematic view of the present invention.
Figure 4:
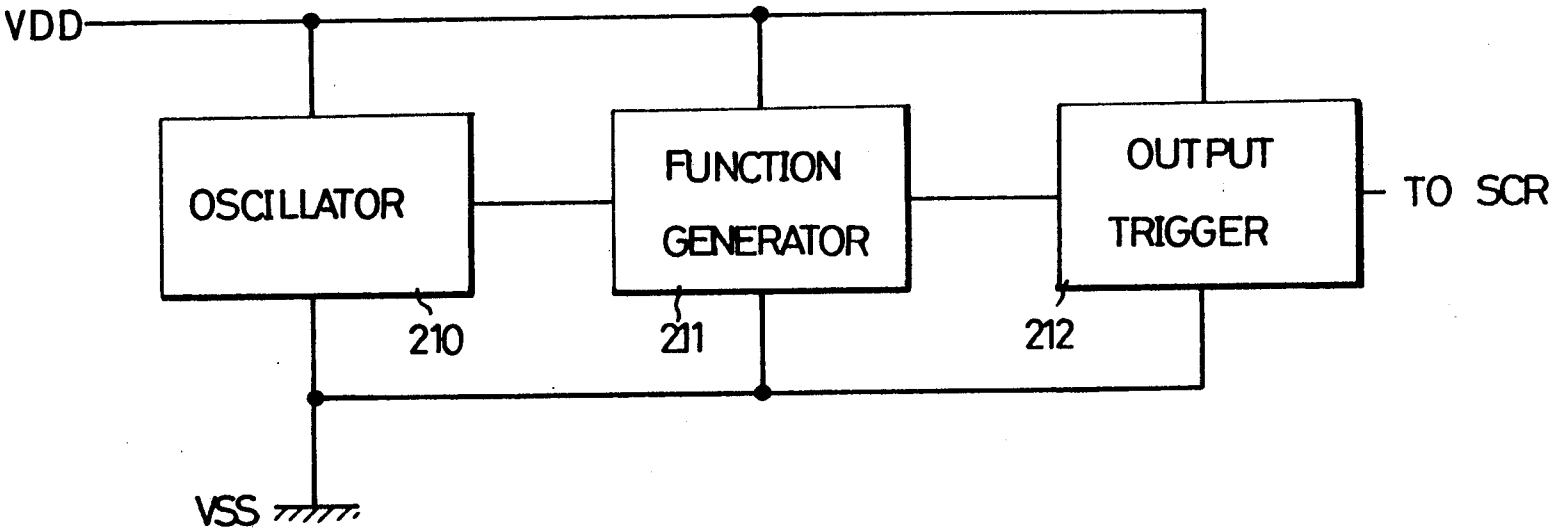
FIG. 4 is a block diagram of a control circuit of a string light controlling apparatus in accordance with the present invention.
Figure 5:
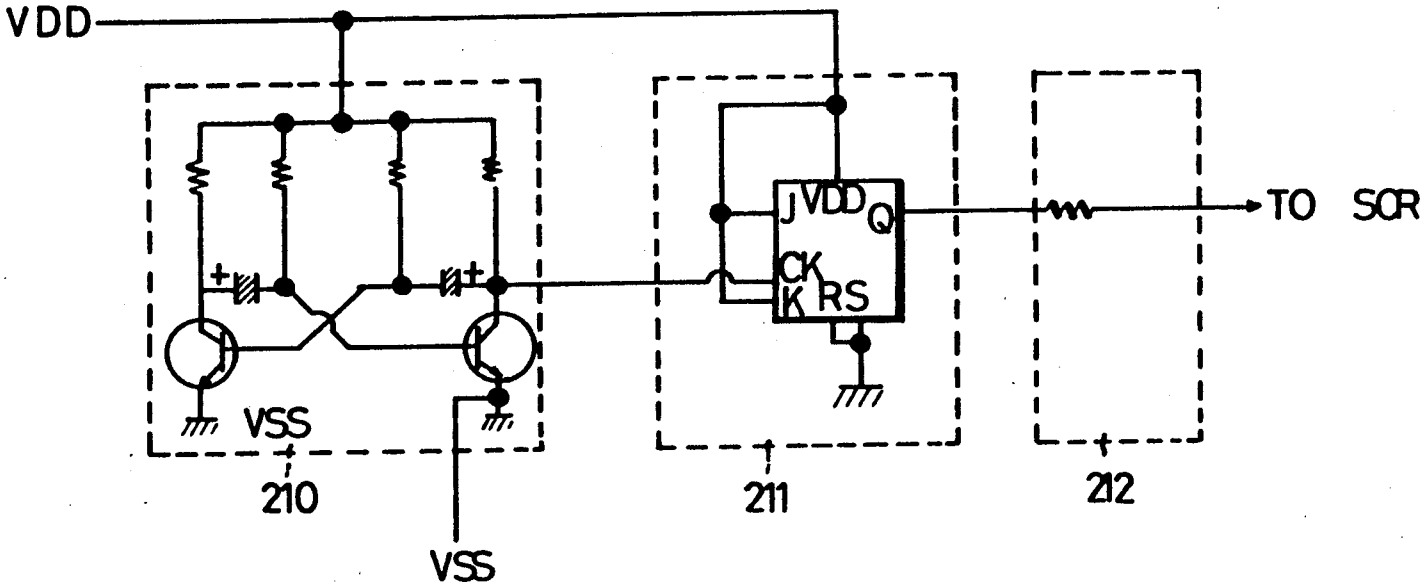
FIG. 5 PRIOR ART
FIG. 5 is a schematic diagram of a conventional control circuit.

Referring to FIG. 3, a practical construction of a light string controlling apparatus 2 comprises a bridge rectifier 25, a RC filter comprising a resistor 23 and a capacitor 24, a control circuit 21, and an SCR (silicon control rectifier) 22. The two AC input terminals of the bridge rectifier 25 are connected to the light string 1. The positive DC output terminal of the bridge rectifier 25 is connected to the anode of the SCR 22, and the negative DC output terminal of the bridge rectifier 25 is connected to a ground and the cathode of the SCR 22. The gate of the SCR 22 is connected to a control circuit 21. Referring to FIG. 4, a control circuit 21, comprising an oscillator 210, a function generator 211, and an output trigger 212, operates to generate a train of pulses or analog signals, or combination of pulses and analog signals to trigger the gate of SCR 22, and control the conducting angle of the SCR 22, thereby, controlling the timing for the flashing and illumination of the light string 1. Referring to FIG. 5, a conventional control circuit is provided. (This is only used as reference, not included in the scope of the present invention.) Therefore, through the incorporation of the control circuit 21 and the SCR 22, the light string 1 receives different cut-off currents from the AC power, causing flashing and variable illumination thereof.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A light string controlling apparatus comprising a bridge rectifier, an RC filter, a control circuit, and a silicon controlled rectifier, said bridge rectifier having two AC input terminals connected in series with a light string having a plurality of light bulbs in series, a DC positive output terminal connected in parallel with said RC filter, and a DC negative output terminal connected to a ground, said RC filter being connected in parallel with said control circuit which is connected to a gate of said silicon controlled rectifier, said silicon controlled rectifier having an anode terminal and a cathode terminal respectively connected to said positive and negative output terminals of said bridge rectifier;

said control circuit comprising an oscillator, a function generator, and an output trigger connected in parallel with each other, said control circuit generating a train of pulses, a train of analog signals, or a combination of pulses and analog signals to trigger the gate of said silicon controlled rectifier to control the conducting angle of said silicon controlled rectifier, thereby controlling the timing for the flashing and illumination of said light string.

* * * * *